US008081906B2

(12) United States Patent
Tanaka

(10) Patent No.: US 8,081,906 B2
(45) Date of Patent: Dec. 20, 2011

(54) IMAGE FORMING APPARATUS WHEREIN, WHEN A ROTARY MEMBER IS LOCATED AT A REFERENCE POSITION, A COLOR DEVELOPING DEVICE IS LOCATED IN A REGION EXTENDING FROM A POSITION OF A TRANSPARENT DEVELOPING DEVICE TOWARD A DOWNSTREAM SIDE OF A ROTATION DIRECTION OF THE ROTARY MEMBER TO A LOWERMOST POINT IN THE GRAVITY DIRECTION OF THE ROTARY MEMBER

(75) Inventor: Akinori Tanaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 457 days.

(21) Appl. No.: 12/329,277

(22) Filed: Dec. 5, 2008

(65) Prior Publication Data

US 2009/0148187 A1 Jun. 11, 2009

(30) Foreign Application Priority Data

Dec. 5, 2007 (JP) ..... 2007-314795

(51) Int. Cl.
*G03G 15/01* (2006.01)

(52) U.S. Cl. ..... 399/227

(58) Field of Classification Search ..... 399/53, 399/227

See application file for complete search history.

(56) References Cited

U.S. PATENT DOCUMENTS 7,349,655 B2 * 3/2008 Fukuda et al. ..... 399/257
7,580,656 B2 * 8/2009 Tanaka ..... 399/227
7,773,915 B2 * 8/2010 Akita ..... 399/223

FOREIGN PATENT DOCUMENTS

JP 2006-251717 A 9/2006

* cited by examiner

*Primary Examiner* — David Gray
*Assistant Examiner* — Gregory H Curran

(57) ABSTRACT

An image forming apparatus includes color developing units for development with color developing agents, a transparence developing unit for development with a transparent developing agent, a rotary member which holds and rotationally moves the color and transparence developing units toward a development position, a driving device which rotationally drives the rotary member, a toner accumulation portion arranged below the rotary member in a gravity direction, falling toner accumulating therein, and a controller capable of starting image formation after the rotary member is moved to a reference position for rotation start. When the rotary member is located at the reference position, stop control thereof is performed such that at least one color developing unit is located in a region arranged downstream of the transparence developing unit and upstream of a lowermost portion of the rotary member in the gravity direction, with reference to the rotation direction of the rotary member.

6 Claims, 11 Drawing Sheets

IMAGE FORMING APPARATUS WHEREIN, WHEN A ROTARY MEMBER IS LOCATED AT A REFERENCE POSITION, A COLOR DEVELOPING DEVICE IS LOCATED IN A REGION EXTENDING FROM A POSITION OF A TRANSPARENT DEVELOPING DEVICE TOWARD A DOWNSTREAM SIDE OF A ROTATION DIRECTION OF THE ROTARY MEMBER TO A LOWERMOST POINT IN THE GRAVITY DIRECTION OF THE ROTARY MEMBER

BACKGROUND OF THE INVENTION

1. Field of the Invention

The present invention relates to image forming apparatuses such as copiers, printers, recorded image displaying apparatuses, and facsimile machines, which form visible images by electrophotographic methods. In particular, the present invention relates to an image forming apparatus which performs image formation by using a rotary developing device rotatably holding a transparence developing unit and a color developing unit.

2. Description of the Related Art

Nowadays, in multifunction apparatuses and facsimiles having copying and printing functions, electrophotographic image forming apparatuses are widely used. In particular, electrophotographic full-color image forming apparatuses are popular.

Reproduction of color images with such full-color image forming apparatuses is promoted. Hence, it is desired to increase image quality, for example, by increasing a color reproduction range and reducing graininess of an image.

Frequently, gloss is entirely applied to an image, so that the image is finished as a photographic image. Also, variation of gloss is applied to an image, so that a new expression not relying on color is applied to the image. Printed products obtained in such manner are common.

Some configurations have been suggested to realize such an expression with an electrophotographic image forming apparatus. The configurations include an image forming method using transparent toner.

For example, Japanese Patent Laid-Open No. 2006-251717 describes a configuration having a developing unit capable of forming a transparent toner image in addition to four color developing units capable of forming four-color toner images. This patent also describes a configuration in which a plurality of image forming portions including a plurality of photosensitive members and corresponding developing units are arranged in a moving direction of an intermediate transfer member (tandem configuration). The patent further describes a configuration in which a photosensitive member is provided and a plurality of developing units are rotationally moved relative to a development position (rotary configuration). The rotary configuration is desirable because the size of the image forming apparatus is easily reduced as compared with the tandem configuration.

On the other hand, the color toner is more likely mixed into the developing unit using the transparent toner than in the case of the developing unit using the color toner. This is because the mixed color is apparent even though only a small amount of the color toner is mixed into the transparent toner.

The inventor has found that such toner mixture may be caused by the following factor in addition to a case in which the color toner is scattered and floated in the image forming apparatus and then mixed into the transparent toner. In particular, assuming that the rotary configuration is employed for the developing units, when the developing units are rotationally moved, development sleeves collect the toner which accumulates after being scattered in the image forming apparatus. In the rotary developing units, in some cases, a toner receiver is provided below a rotary unit which holds and rotates the developing units. The toner receiver receives the toner falling from the developing unit, and the toner accumulates therein. When the accumulated amount of the toner increases such that a moving locus of the development sleeve during rotation of the rotary unit interferes with the accumulated toner, the development sleeve collects the toner accumulated in the toner receiver. Hence, toner of one color may mix with toner of other colors.

The inventor has found that the toner mixture caused by the toner accumulated in the toner receiver is more noticeable in a certain developing unit in the apparatus in which the rotary unit is moved to a reference position (home position) for rotation start every image formation operation. The developing unit is one that firstly reaches the toner accumulated portion after the rotary unit is located at the home position and then rotation of the rotary unit is started. While the rotary unit is rotated, the development sleeves of the rotated developing units collect the toner that accumulates in the toner receiver by a small amount at a time. Thus, the collecting amounts may become substantially uniform among the developing unit. However, when the rotary unit is located at the home position and is in a standby state, the developing units do not collect the toner. Hence, the accumulated amount of the falling toner may increase. Then, when the rotation of the rotary unit is started, the developing unit which firstly reaches the position collects a large amount of toner. Thus, the toner mixture phenomenon occurs.

The toner accumulated in the toner receiver causes the toner to be mixed by a larger amount than the toner floating in the apparatus does. In the developing unit using the transparent toner, the toner mixture should be particularly considered.

SUMMARY OF THE INVENTION

Accordingly, the present invention prevents a color toner from being mixed to a transparent toner in a transparence developing unit held by a rotary member having a reference position for rotation start and being subjected to movement control.

In particular, according to an aspect of the present invention, an image forming apparatus includes an image bearing member on which an electrostatic image is formed; a color developing unit having a color developing agent bearing member configured to bear a color developing agent containing a color toner, the color developing unit configured to develop the electrostatic image formed on the image bearing member at a development position; a transparence developing unit having a transparent developing agent bearing member configured to bear a transparent developing agent containing a transparent toner, the transparence developing unit configured to develop the electrostatic image formed on the image bearing member at the development position; a rotary member configured to hold the color developing unit and the transparence developing unit and to rotationally move the held color developing unit and the held transparence developing unit toward the development position; a driving device configured to rotationally drive the rotary member; a toner accumulation portion arranged below the rotary member in a gravity direction, falling toner accumulating therein; and a controller configured to control the driving device such that the rotary member is in a standby state at a reference position before image formation. When the rotary member is located at the reference position, the color developing agent bearing member is located in a region extending from a position of the transparent developing agent bearing member toward a downstream side of a rotation direction of the rotary member to a lowermost point in the gravity direction of the rotary member.

Further features of the present invention will become apparent from the following description of exemplary embodiments with reference to the attached drawings.

DESCRIPTION OF THE EMBODIMENTS

Various embodiments of an image forming apparatus according to the present invention are described below with reference to the attached drawings.

First Embodiment

Figure 1:
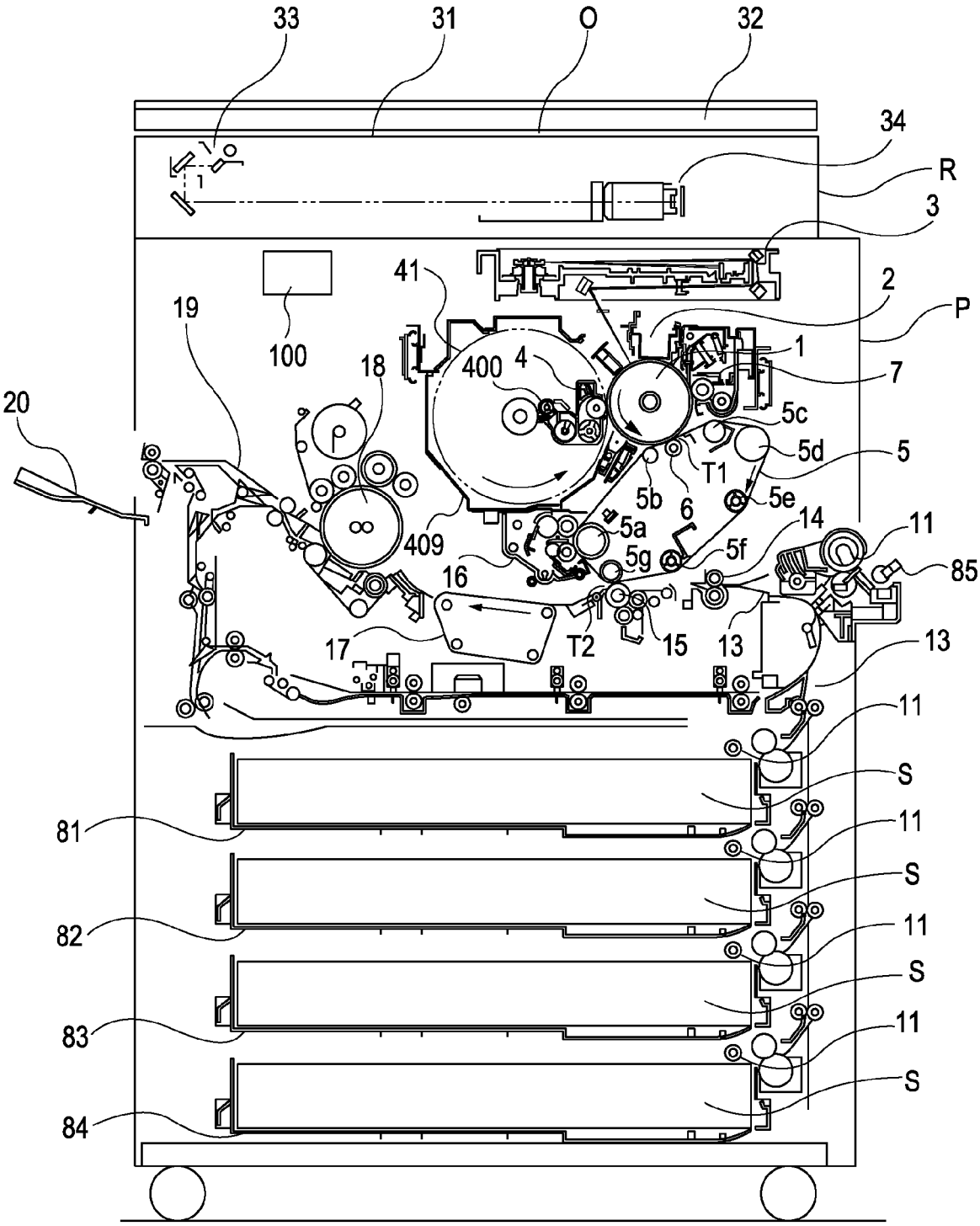
FIG. 1 is a cross-sectional view showing an image forming apparatus according to a first embodiment of the present invention.

FIG. 1 is a general configuration diagram showing an exemplary image forming apparatus in accordance with the present invention. The image forming apparatus is an electrophotographic full-color image forming apparatus, which includes a digital color image reading section R in an upper portion and a digital color image forming section P in a lower portion.

The image reading section R has an original glass plate 31 and an original pressure plate 32 capable of opening and closing the original glass plate 31. A color original O is placed on the original glass plate 31 such that an image surface faces downward, so as to be aligned with a predetermined positional reference. Then, the original pressure plate 32 covers the original glass plate 31. Thusly, the original O is set.

A movable optical system 33 is driven along a lower surface of the original glass plate 31. The movable optical system 33 optically scans the face-down image surface of the original O on the original glass plate 31. The original scanning light forms an image on a CCD 34, which is a photoelectric conversion element (solid-state image sensor). The image is read by the CCD 34 through color separation into three primary colors of red, green, and blue (RGB).

Signals of read RGB are input to an image processing portion (not shown).

The image forming apparatus P is an electrophotographic image forming mechanism having a drum, a rotary development configuration, and an intermediate transfer configuration.

The operation of the image forming apparatus P is briefly described as follows.

An electrophotographic photosensitive drum (hereinafter, referred to as photosensitive drum) 1, which serves as an image bearing member, is exposed with an image signal by using a laser scanner 3, which serves as an exposure apparatus, thereby forming an electrostatic image.

The electrostatic image formed on the photosensitive drum 1 is processed for every color sequentially by a plurality of developing units arranged in the development rotor. Each developing unit is supplied with a toner contained in a corresponding toner container through a supply pipe (supply path) 400.

The toner image of every color on the photosensitive drum 1 is sequentially primarily transferred on an intermediate transfer belt (hereinafter, referred to as belt) 5, which serves as an intermediate transfer member. Hence, toner images are combined on the belt 5. Then, the toner images are collectively secondarily transferred on a recording material S, and fixed thereto, so as to output a full-color image formation product.

A detailed description is given below.

The photosensitive drum 1 is rotationally driven at a predetermined speed counterclockwise as indicated by an arrow. The surface of the photosensitive drum 1 is uniformly charged to have predetermined polarity and potential by a charging device 2, which serves as a charging apparatus. The charged surface is exposed and scanned with laser by the laser scanner 3, which serves as the exposure apparatus.

The laser scanner 3 has, for example, a laser output portion, a polygonal mirror, an imaging lens, and a folding mirror. The laser scanner 3 outputs laser light (optical signal) which is modulated in accordance with an image information signal input from the image processing portion. Hence, the charged surface of the rotated photosensitive drum 1 is exposed and scanned with the laser light. With the scanning exposure, an electrostatic image corresponding to a scanning exposure pattern is formed on the surface of the photosensitive drum 1.

The above-mentioned image information signal is not limited to image information read from the reading section R, and may be information formed by combining image information electrically transmitted from an external device such as a personal computer.

The electrostatic image is developed by a rotary developing device into a toner image.

The rotary developing device is configured such that a plurality of developing units 4 (4*a* to 4*e*) are mounted to a development rotor 41, which serves as a rotary member. The developing units 4 respectively contain color developing agents including different color toners. The held developing units 4 are rotationally movable. Each color developing agent includes a nonmagnetic color toner and a magnetic carrier.

When the development rotor 41 is rotated in a direction indicated by an arrow in the drawing at a predetermined angle at a predetermined control timing, each developing unit 4 is sequentially arranged at a development position at which the developing unit faces the photosensitive drum 1. At the development position, a distance between the photosensitive drum 1 and a development sleeve of the corresponding developing unit is held within a given range.

The belt 5 is an endless belt made of a flexible dielectric material. The belt 5 is wound around a plurality of rollers 5*a* to 5*g* in a stretched manner. The outer surface of the belt 5 is in contact with the photosensitive drum 1 in a region between the rollers 5*b* and 5*c*. This contact portion is a primary transfer nip portion T1.

In the primary transfer nip portion T1, a primary transfer member (transfer roller) 6 is arranged at a position opposite to the photosensitive drum 1 with respect to the belt 5. The primary transfer member 6 is in contact with the inner surface of the belt 5.

A primary transfer voltage, which has a reversed polarity to the polarity of the toner, is applied to the primary transfer roller 6 at a predetermined control timing. The belt 5 is rotationally driven clockwise as indicated by an arrow at a speed substantially equivalent to a rotational speed of the photosensitive drum 1, for example, by the roller 5*a* serving as a driving roller.

A first color toner image is formed on the photosensitive drum 1 in the above-described image formation process including charging, exposing, and developing. Then, the toner image is transferred onto the belt 5 at the primary transfer nip portion T1.

A primary transfer remaining toner, which is not transferred onto the belt 5 and remains on the surface of the photosensitive drum 1, is removed from the surface of the photosensitive drum 1 by a drum cleaning device 7. The photosensitive drum 1 cleaned up by the drum cleaning device 7 is repeatedly used for image formation.

An image formation process similar to the above-described process is continuously repeated for second and subsequent colors. Accordingly, toner images, in which the toner images of the respective development colors are sequentially transferred in a superposed manner, are formed on the belt 5.

Meanwhile, a sheet feed roller 11 of a sheet feed portion, which is previously selected from a plurality of sheet feed portions of first to fourth sheet feed cassettes 81 to 84 and a manual feed tray 85, is driven at a predetermined control timing. Accordingly, a single recording material S contained in that sheet feed portion is separated and fed to a registration roller 14 through a sheet path 13.

The registration roller 14 handles skew correction of the recording material S and controls a secondary transfer timing of the toner images from the belt 5 onto the recording material S. The registration roller 14 receives and temporarily stops a leading edge of the recording material S which is fed from the sheet feed portion.

A secondary transfer member (transfer roller) 15 is arranged at a position such that the belt 5 is interposed between the secondary transfer roller 15 and the roller 5*g*, which serves as an opposite roller. The roller 5*g* is one of a plurality of rollers 5*a* to 5*g* which support the belt 5. The secondary transfer roller 15 is shifted between a first condition in which the secondary transfer roller 15 is pressed to the belt 5 with a predetermined pressure, and a second condition in which the secondary transfer roller 15 is separated from the outer surface of the belt 5, and thus, attachment and detachment of the secondary transfer roller 15 is controlled by way of a pressure control mechanism (not shown).

The secondary transfer roller 15 is normally shifted to and held in the second condition in which the secondary transfer roller 15 is separated from the outer surface of the belt 5. By shifting the secondary transfer roller 15 to the first condition, a secondary transfer nip portion T2 is formed between the secondary transfer roller 15 and the outer surface of the belt 5, thereby performing a secondary transfer operation.

The secondary transfer roller 15 is shifted to the first condition at a predetermined control timing. Also, feeding of the recording material S temporarily stopped at the position of the registration roller 14 is resumed from the registration roller 14 at a predetermined control timing. Then, the fed recording material S enters the secondary transfer nip portion T2 between the belt 5 and the secondary transfer roller 15 shifted to the first condition.

The recording material S is nipped and conveyed by the secondary transfer nip portion T2. During this conveyance, a predetermined secondary transfer voltage is applied to the secondary transfer roller 15. Hence, the toner images formed of the plurality of colors on the belt 5 are collectively electrostatically transferred on the recording material S.

A secondary transfer remaining toner, which is not transferred onto the recording material S and remains on the surface of the belt 5, is removed from the belt surface by a belt cleaning device 16. The belt 5 cleaned up by the belt cleaning device 16 is repeatedly used for image formation.

The belt cleaning device 16 is normally held in a condition in which the belt cleaning device 16 is separated from the outer surface of the belt 5. When the toner images are secondarily transferred from the belt 5 onto the recording material S at the secondary transfer nip portion T2, the belt cleaning device 16 is shifted to a condition in which the belt cleaning device 16 is in contact with the outer surface of the belt 5 at a predetermined control timing.

The recording material S exited from the secondary transfer nip portion T2 is separated from the surface of the belt 5 and is conveyed to a fixing device 18 by a conveyance belt unit 17. Then, unfixed toner images are fused on the recording material S by heat and pressure, and hence, fixed images are formed. The recording material S exited from the fixing device 18 is conveyed through a sheet path 19 and discharged onto a sheet output tray 20.

Meanwhile, in the image forming apparatus, it is difficult to increase the volume of a developing agent container of the developing unit 4 because the shift speed and the driving torque of the development rotor 41 are limited.

Owing to this, a toner cartridge (not shown) is arranged outside the development rotor 41. The development rotor 41 has the supply path (supply pipe) 400 therein. The supply path 400 receives the toner and conveys the toner to the developing unit. In the supply path 400, a conveyance screw is arranged for the conveyance of the toner.

Also, the belt cleaning device 16 is arranged near a lower portion in a gravity direction of the development rotor 41.

Further, a toner receiver 409 is provided as a toner accumulation portion at the lower portion in the gravity direction of the development rotor 41. The toner receiver 409 receives the toner falling from the developing unit for some reasons, so as to prevent the toner from falling to the further lower side. The toner receiver 409 is formed of, for example, a wall member surrounding the lower portion and a lateral portion of the development rotor 41. A portion of the wall member located below the development rotor 41 defines the toner receiver 409 which receives the falling toner. A distance between a locus of the outer periphery of the development sleeve, the locus which corresponds to the outermost periphery of a rotational locus of the development rotor 41 (the circumference plotted by two-dot chain line of the development rotor 41 in FIG. 1), and a bottom portion of the wall member is about 6 mm in this embodiment.

When the wall member is made of metal, the value of 6 mm is set on the basis of a distance so as not to affect the magnetic pole arranged inside the development sleeve (so as not to significantly disorder magnetic flux from the magnetic pole).

Now, with reference to the detailed drawings, a configuration of preventing colors of toners in the development rotor from being mixed in the image forming apparatus of this embodiment is specifically described.

Figure 2:
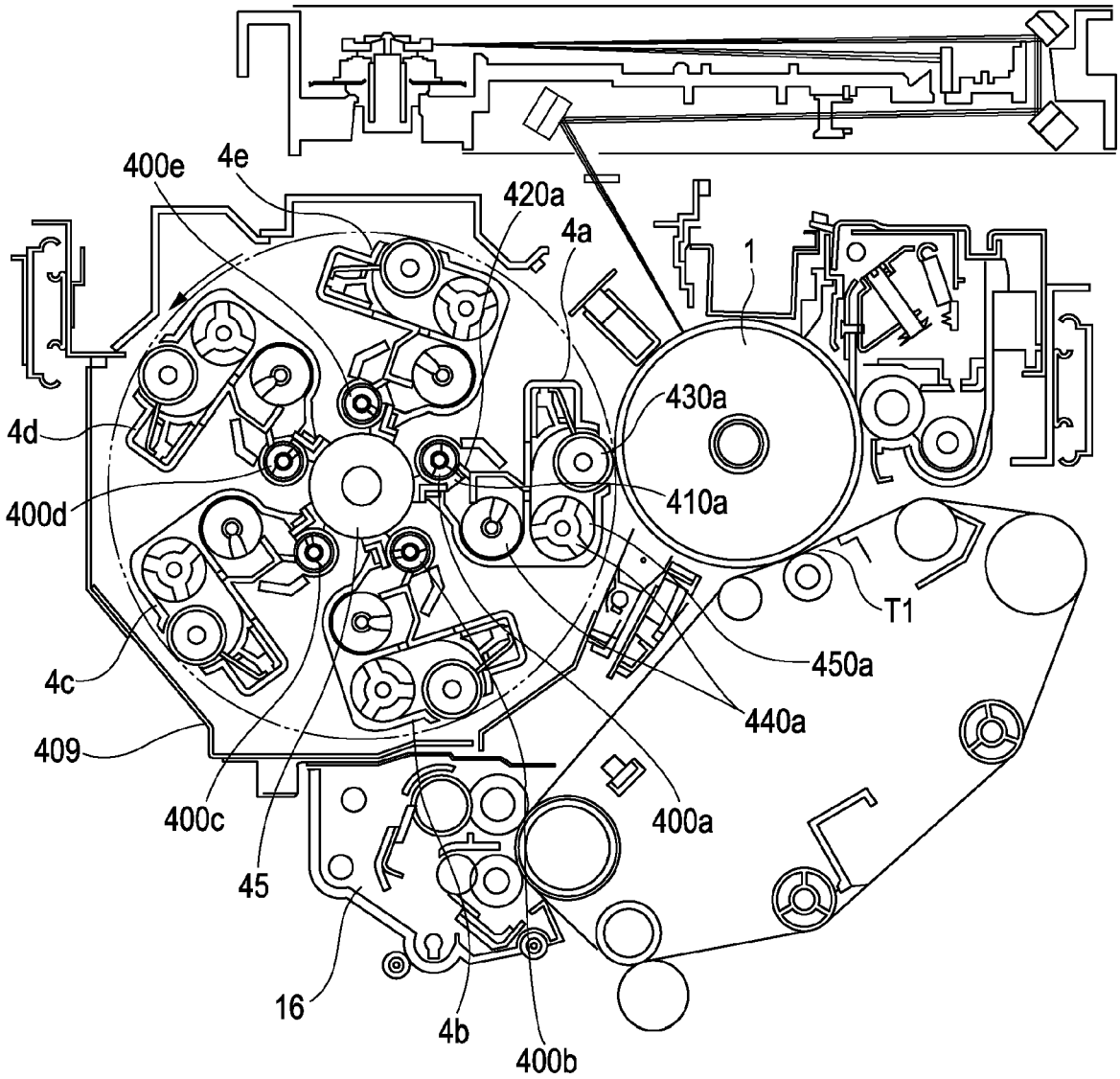
FIG. 2 is a cross-sectional view specifically showing a development rotary portion of the image forming apparatus according to the first embodiment.

FIG. 2 is a cross-sectional view specifically showing the periphery of a development rotary portion of the image forming device, which includes the rotary developing device and its developing units according to the first embodiment of the present invention.

A developing unit 4*a* is a developing unit containing a developing agent including a transparent toner. A supply pipe (supply path) 400*a* allows the transparent toner to be supplied therethrough.

Similarly, a developing unit 4*b* contains a yellow developing agent, a developing unit 4*c* contains a magenta developing agent, a developing unit 4*d* contains a cyan developing agent, and a developing unit 4*e* contains a black developing agent. Also similarly, a supply pipe (supply path) 400*b* supplies a yellow toner, a supply pipe (supply path) 400*c* supplies a magenta toner, a supply pipe (supply path) 400*d* supplies a cyan toner, and a supply pipe (supply path) 400*e* supplies a black toner. These developing units have basically similar configurations. Also, the toner supply paths have basically similar configurations.

The transparence developing unit 4*a* includes a development container 450*a* containing a transparent developing agent including a transparent toner, a development sleeve 430*a* serving as a transparent developing agent bearing member which bears the transparent developing agent, and a stirring and conveying member 440*a* which stirs and conveys the developing agent in the development container 450*a*. Also, a magnet having a plurality of magnetic poles is arranged in the development sleeve 430*a*. The magnet bears and conveys the magnetic developing agent. The supply developing agent discharged from the supply path 400*a* enters the development container 450*a* through a developing agent supply port 410*a*.

The color developing units 4*b* to 4*e* each include a development container which contains a color developing agent including a color toner, a development sleeve serving as a color developing agent bearing member which bears the color developing agent, and a stirring and conveying member which stirs and conveys the developing agent in the development container. Also, a magnet having a plurality of magnetic poles is arranged in the development sleeve. The magnet bears and conveys the magnetic developing agent. The supply developing agent discharged from each of the supply paths 400*b* to 400*e* enters the corresponding development container through a corresponding supply port.

The plurality of developing units 4*a* to 4*e* are held by the development rotor serving as the rotary member and are rotated. The development sleeves of the developing units 4*a* to 4*e* are located at substantially equivalent distances from the rotation center of the development rotor. Accordingly, rotational loci of the development sleeves during rotation of the rotary developing device are substantially aligned with each other.

FIG. 2 illustrates that the transparence developing unit 4*a* performs development as a first color in the order of development. The rotary developing device is rotated counterclockwise, or in a direction indicated by an arrow in the drawing.

Next, configurations of a toner supply portion and a toner supply path to the developing unit are described in detail with reference to FIGS. 3 to 6.

Figure 3:
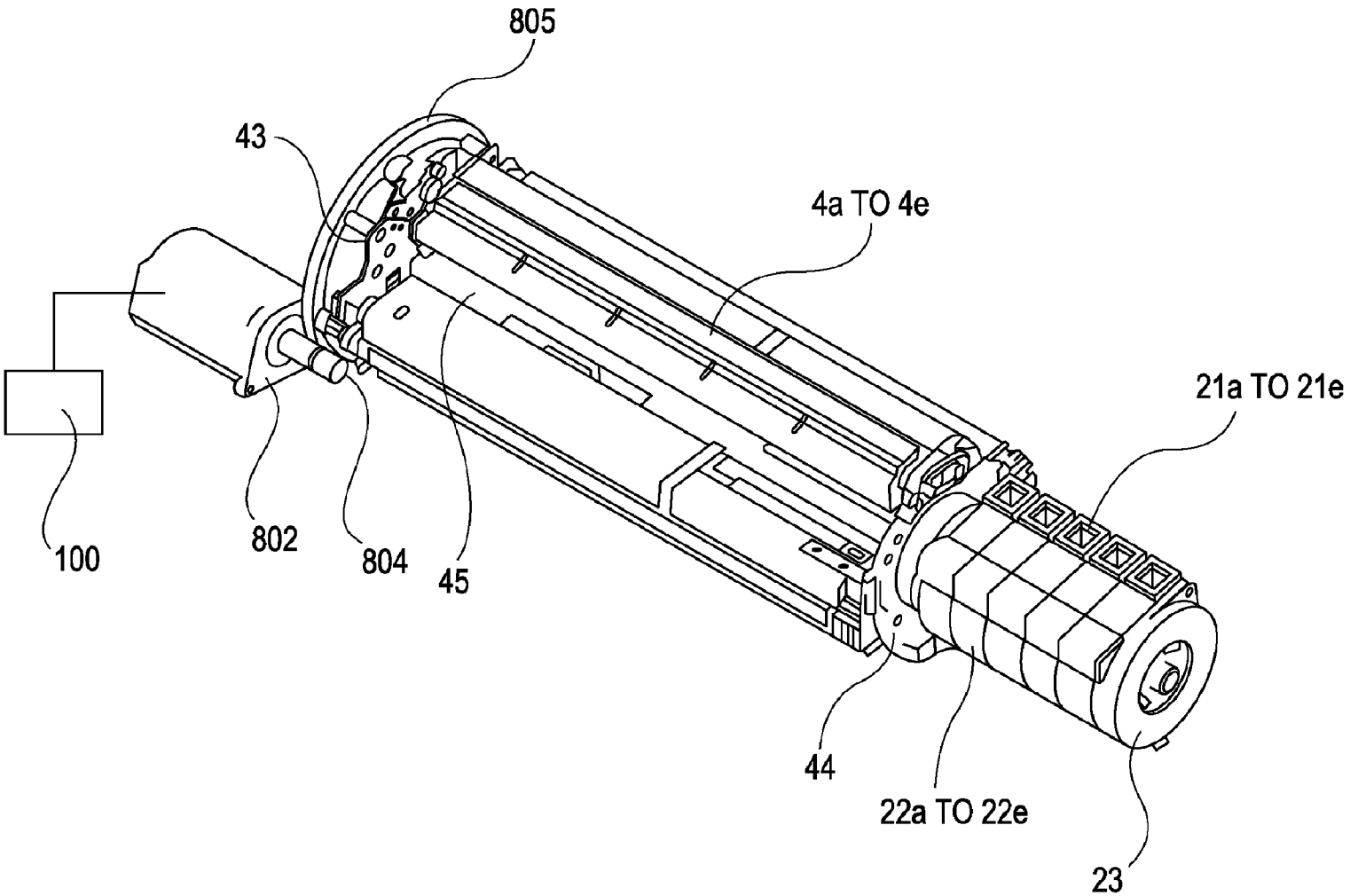
FIG. 3 is a perspective view showing the periphery of a rotary developing device according to the first embodiment.
Figure 4:
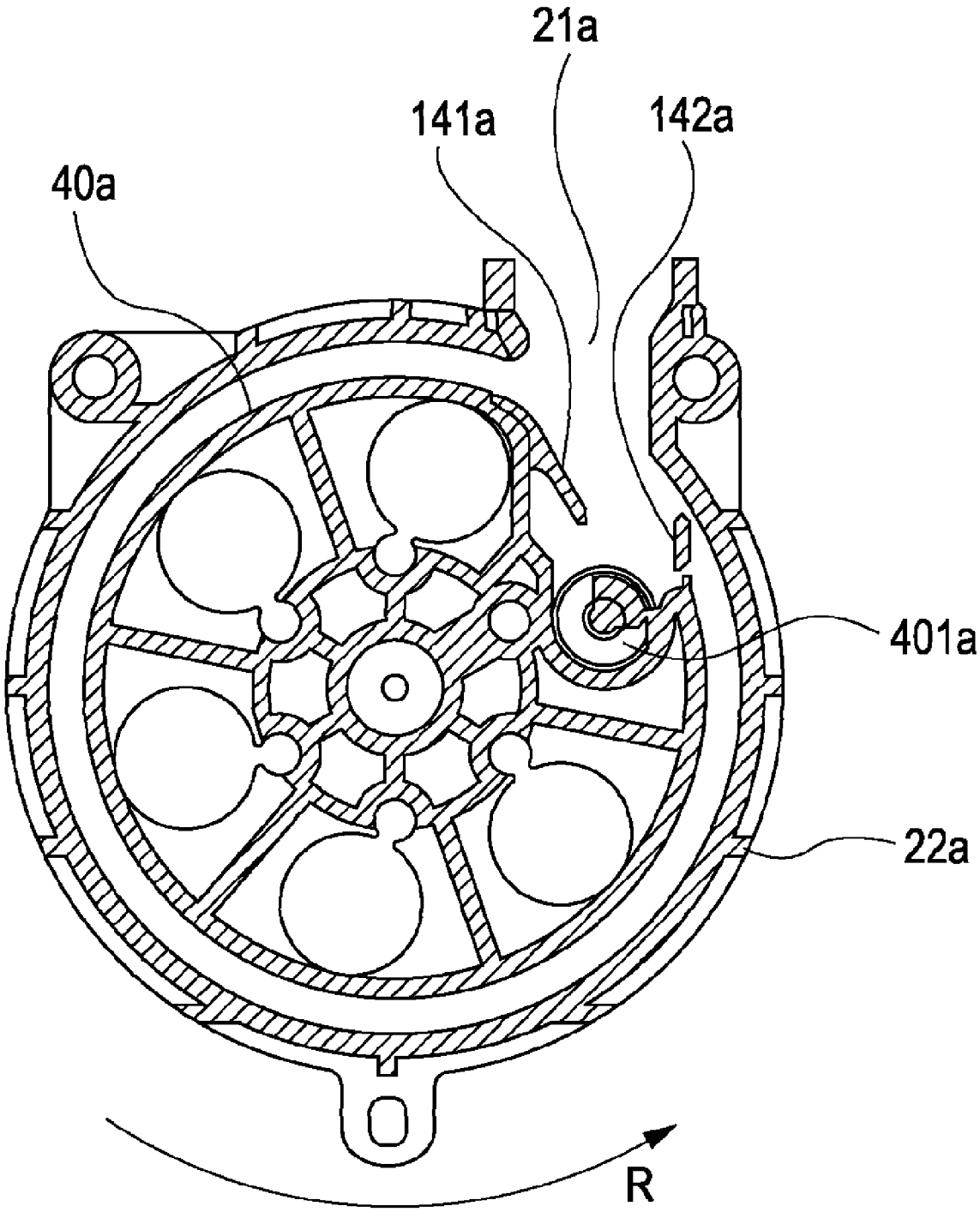
FIG. 4 is a cross-sectional view showing a lateral portion of a toner receiver of the rotary developing device when toner supply is available according to the first embodiment.
Figure 5:
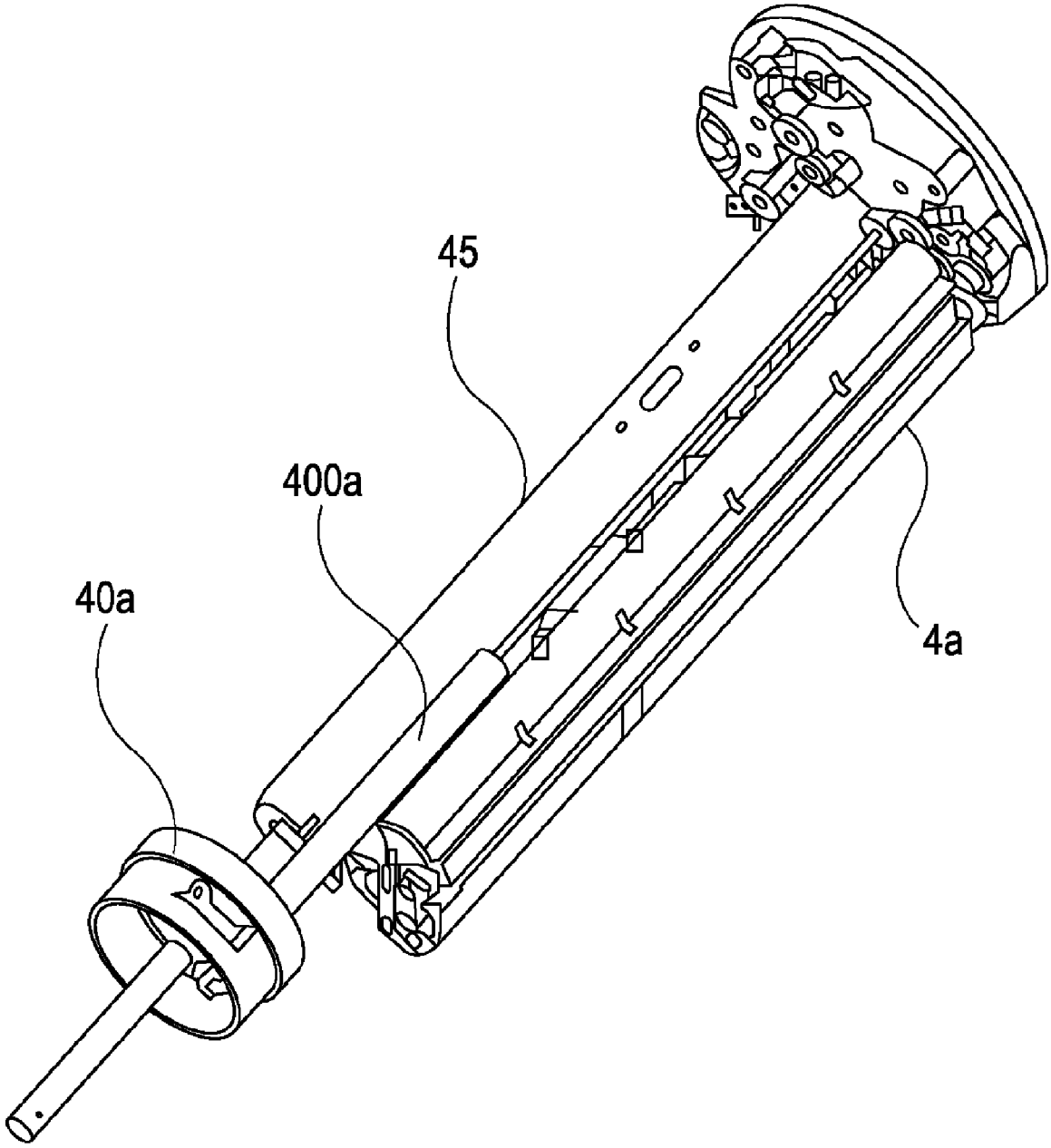
FIG. 5 is a perspective view showing a supply path of a toner to a developing unit of the rotary developing device according to the first embodiment.
Figure 6:
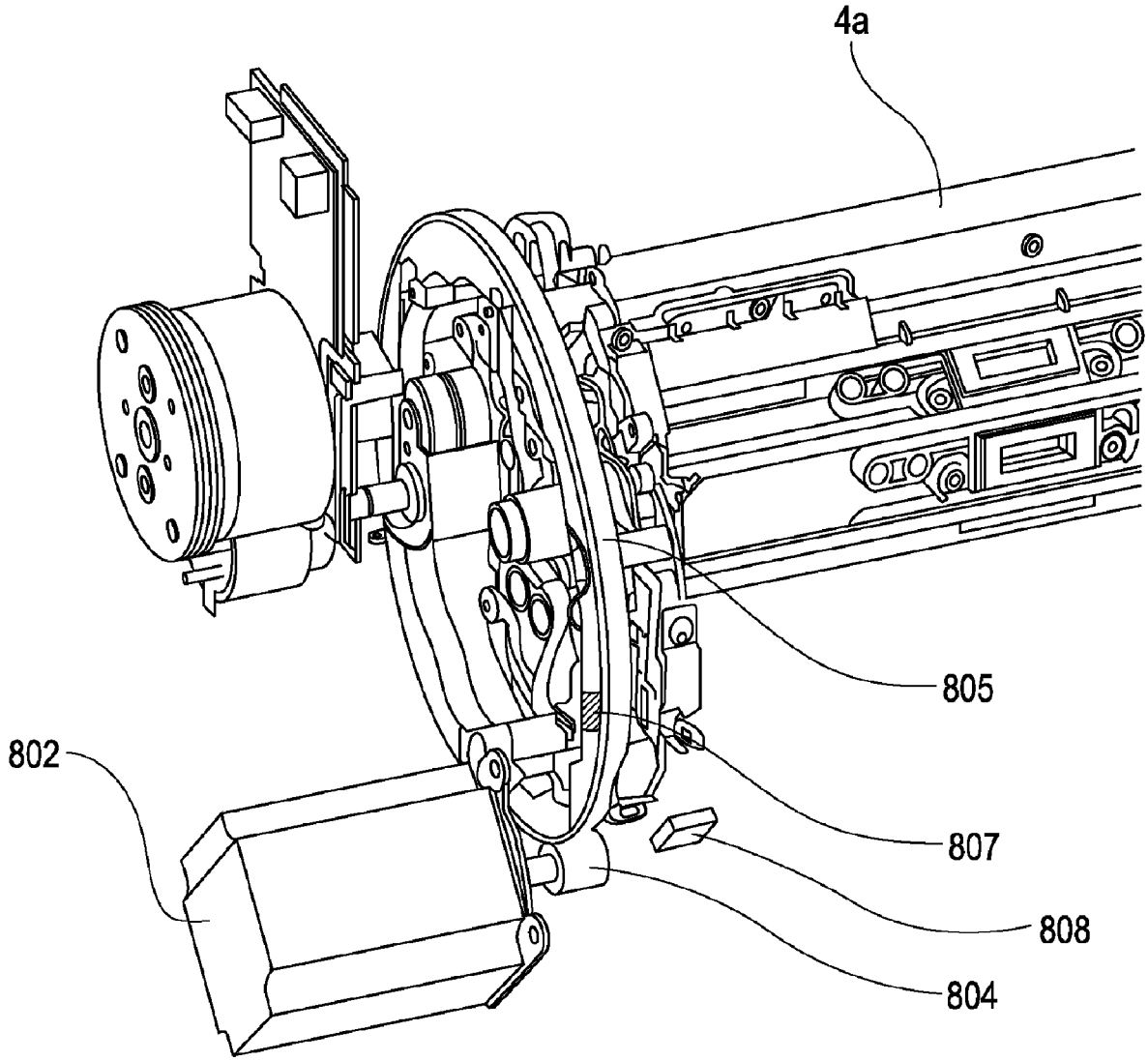
FIG. 6 illustrates the periphery of a driving device portion of the rotary developing device according to the first embodiment.

FIG. 3 is a perspective view showing an upper portion of a rotary developing device and a toner supply port portion with the developing units mounted. FIG. 4 is a cross-sectional view showing a lateral portion of a toner receiver of the rotary developing device. FIG. 5 is a perspective view showing a supply path of the toner to a developing unit of the rotary developing device. Also, FIG. 6 illustrates a driving device portion of the rotary developing device.

The rotary developing device includes a rear side plate unit 43, a front side plate unit 44, and a coupling stay unit 45. The development rotary portion is rotatably supported at a body of the image forming apparatus by way of flanges (not shown) attached to front and rear side plates thereof.

A driving gear 805 is rotationally driven by a rotary motor gear 804 provided at a rotary driving device (rotary motor) 802 which is attached to a body frame of the image forming apparatus. Hence, the driving gear 805 sequentially shifts the developing units 4*a* to 4*e*. A controller (CPU) 100 controls the operation of the rotary motor 802.

The controller 100 also controls the image formation operation of the image forming apparatus.

The rotary motor 802 sequentially shifts the developing units 4*a* to 4*e* within a short time of about 200 msec, assures that a rotation angle is highly accurately, and holds each developing unit at a developing unit stop position, thereby employing a stepping motor.

Fixed flanges 22*a* to 22*e* having toner receiving portions 21*a* to 21*e* are disposed at and fixed to the body frame at the front side of the rotary developing device. A flange cover 23 is provided at an end portion of the fixed flanges 22*a* to 22*e*. Hence, a toner receiving unit portion is defined. The toners fed from toner cartridges (not shown) are respectively received by the toner receiving portions 21*a* to 21*e*.

FIG. 4 is a cross-sectional view showing a transparence supply path portion while the transparence developing unit 4*a* is located at the development position. The path for the toner supply is defined by the fixed flange 22*a* having the toner receiving portion 21*a*, a rotary drum 40*a* which is rotated integrally with the rotary developing device, and the supply path 400*a* including the screw which conveys the toner to the developing unit 4*a*. The path is connected from a conveying path (not shown) provided in the fixed flange 22*a* to the supply path 400*a* only when the corresponding developing unit is located at the development position. When the path is connected, the toner received by the toner receiving portion 21*a* can be handed to a conveyance screw portion 401*a*.

Next, the conveyance of the toner during supply is described below in detail.

Referring to FIG. 4, the toner received through the toner receiving portion 21*a* falls downward in the gravity direction, and reaches the conveyance screw portion 401*a*.

Then, as shown in FIG. 4, a path is connected from the toner receiving portion 21*a* to the conveyance screw portion 401*a* in the gravity direction (vertical direction) only when the rotary developing device is at a certain angle, and the toner can be conveyed to the developing unit.

The rotary drum 40*a* is rotated in a direction indicated by an arrow R in the drawing integrally with the developing unit. The rotary drum 40*a* has a wall 141*a* for stopping backflow of the toner, and a recovery wall 142*a* for collecting the toner. Hence, all of the supplied toner can be conveyed to the developing unit.

A toner conveying unit is defined by the rotary drum 40*a*, and the conveyance screw portion 401*a* including the conveyance screw which conveys the toner to the developing unit 4*a*.

The toner conveyed from the toner cartridge is conveyed to the toner receiving portion 21*a* shown in FIG. 3. By the rotation of the rotary developing device, the toner falls into the rotary drum 40*a* with the opening facing upward, so that the toner is supplied thereto.

Referring to FIG. 5, since the falling toner is conveyed to the developing unit 4*a*, the toner supply path 400*a* is arranged inside a cylinder of the rotary drum 40*a*, and is rotated with the developing unit 4*a*.

The rotary drum 40*a* is configured such that the opening faces directly upward only when the developing unit 4*a* is located at the development position. Accordingly, the toner of only the development color can be supplied during development.

Also, referring to FIG. 2, the toner supply path 400*a* has the opening (toner receiving portion) corresponding to the developing agent supply port 410*a* of the developing unit 4*a* for receiving the supply. Using the gravity, the toner is supplied to the developing unit 4*a*.

The toner receiving portion is sealed with a sponge seal member 420*a* to prevent the toner from leaking to the outside.

However, as the number of sheets produced by the image forming apparatus approaches to an endurance number of sheets, the toner may leak to the surface of the seal due to scattering of the toner by an extremely small amount.

This may be also caused by leakage due to an infinitesimal deformation of the developing unit occurring, for example, when the developing unit is shifted. If the amount of the leaked toner increases to a certain degree, the toner may be accumulated on the toner receiver 409 at the lower portion of the rotary developing device via the developing unit by an extremely small amount at a time.

Further, for example, when the developing unit is detached for maintenance or the like of the image forming apparatus, the toner and the developing agent may slightly leak from the receiving opening of the supply path 400*a* to the developing unit or from the detached developing unit.

Figure 7:
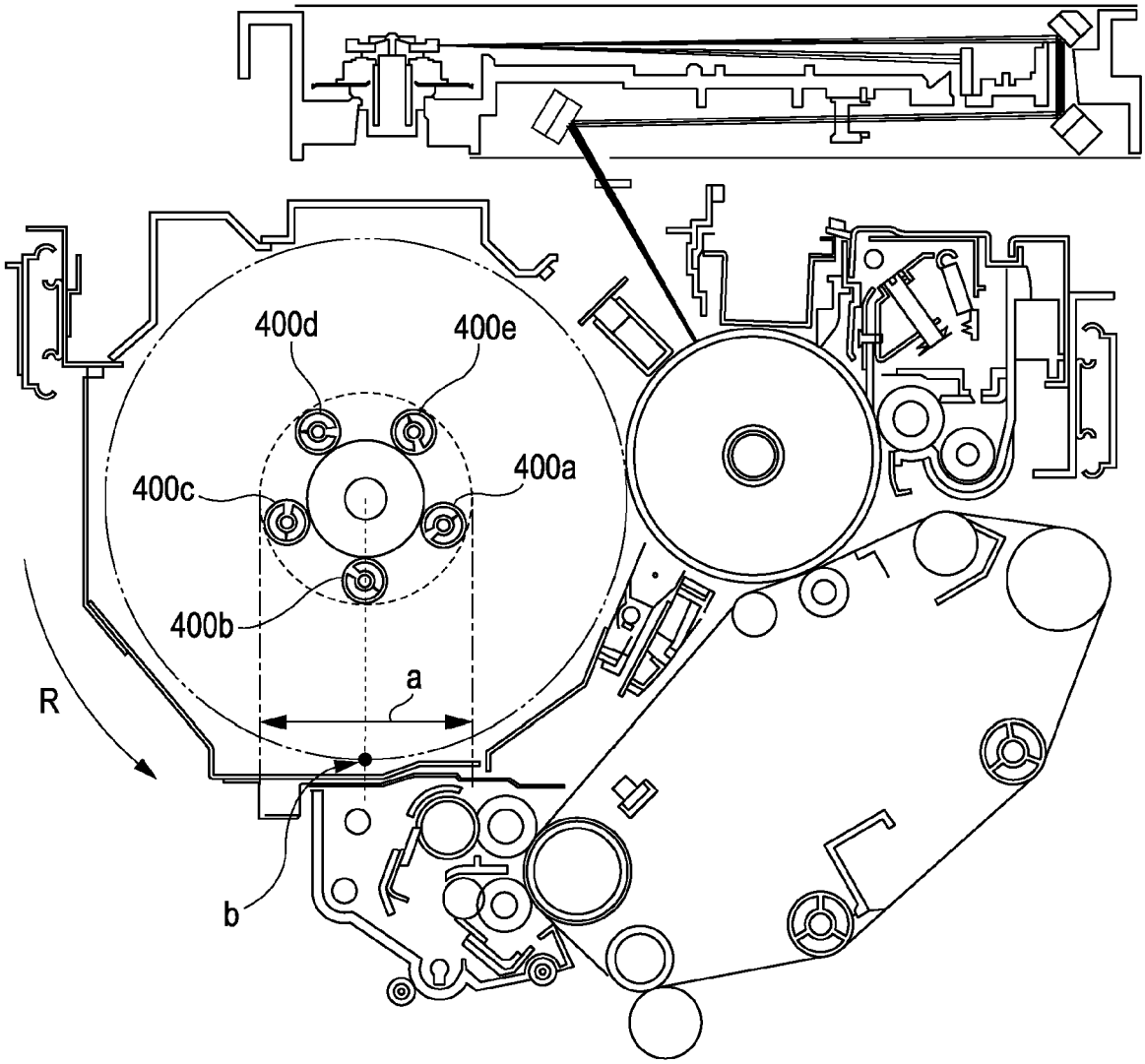
FIG. 7 illustrates a region in which a toner falls from the rotary developing device and accumulates.
Figure 8:
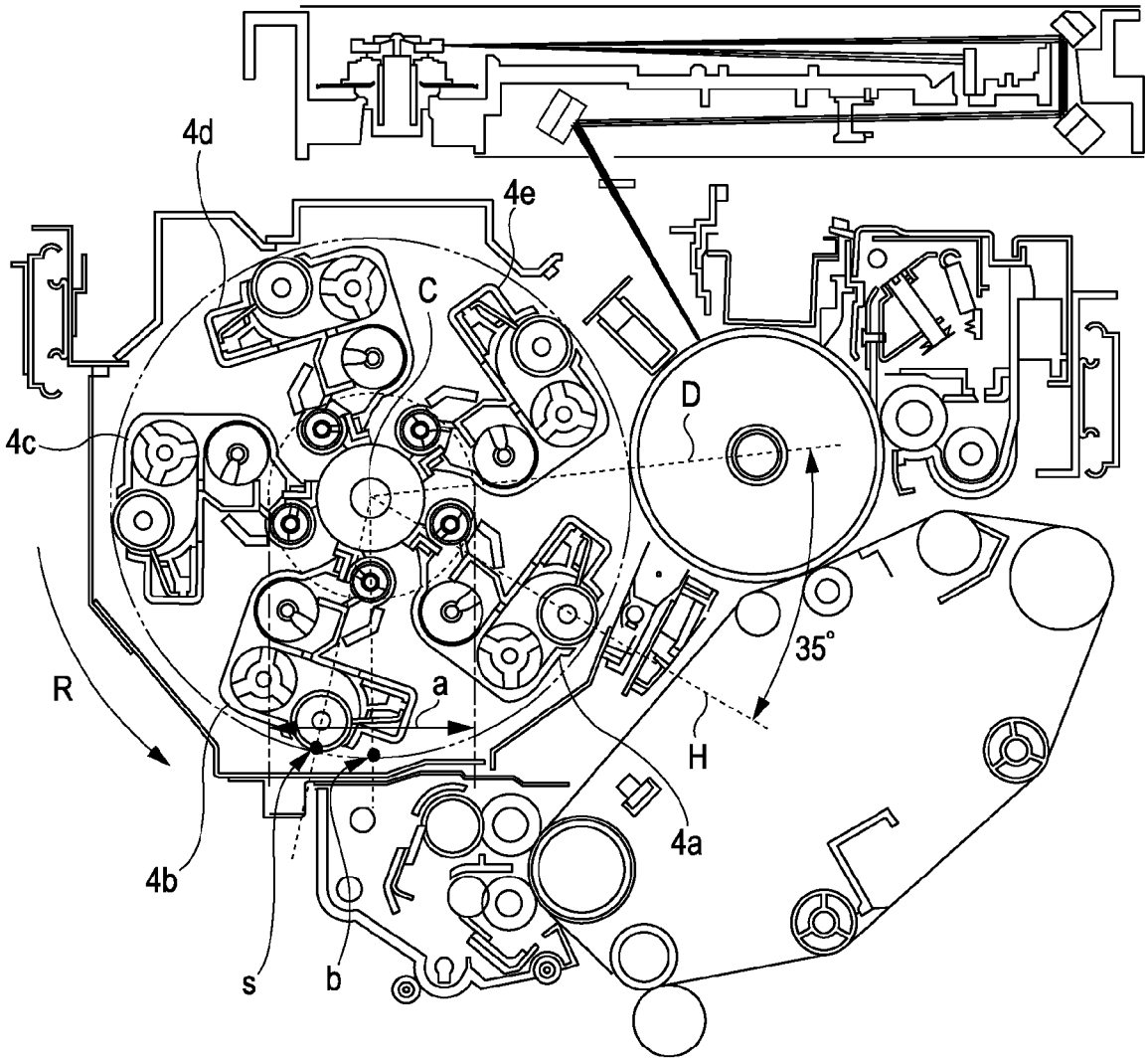
FIG. 8 illustrates a home position of the rotary developing device according to the first embodiment.

The toner and the developing agent are accumulated in a region "a" located near the lowermost portion of the rotary developing device in the gravity direction as shown in FIGS. 7 and 8. The region "a" is a region defined such that a circular locus (dotted line in the drawing) of the supply paths 400*a* to 400*e* rotated by the rotation of the rotary developing device is projected downward in the gravity direction.

In the region, the toner, which is scattered at or leaks from the toner receiving portion when the toner is to be supplied to the development container, or the toner, which leaks from the opening of the supply path when the developing unit is detached, is accumulated.

When the accumulated amount of the toner exceeds a certain range, the toner is received by the developing unit via the development sleeve, and color mixture may occur. In the region "a", a position at which the toner is most likely received by the developing unit is a lowermost portion b of the rotary developing device in the gravity direction. This is because the lowermost portion b is close to the toner receiver 409.

Particularly for the developing unit using the transparent toner, the color mixture seriously affects an image as compared with the developing unit of other color. So, this embodiment prevents the color mixture by controlling the position of each developing unit during the standby state of the rotary developing device.

FIG. 8 illustrates a standby position (reference position for rotation start) of the developing unit, that is, a home position H of the development rotary portion, according to this embodiment. The home position (reference position for the rotation start) is a position at which the rotary developing device is stopped when the image formation operation is not performed. The controller 100 performs stop control of the rotary developing device such that the rotary developing device is stopped at the home position. The home position is provided because the position of other developing unit can be constantly accurately recognized with reference to the home position as the reference position during rotation, and hence the developing unit can be moved to the development position constantly accurately.

When the transparence developing unit 4*a* containing the transparent developing agent is stopped at the home position, the transparence developing unit 4*a* is located at a position at 35° toward an upstream side in the rotary developing device rotation direction with reference to the development position D. Since the rotary developing device is rotationally driven counterclockwise (R), the developing unit that develops the electrostatic image first is the transparence developing unit 4*a*.

Herein, the angle is defined by using a line connecting the rotation center of the development sleeve with the rotation center of the rotary developing device. At the development position D, the rotation center of the rotary developing device, the rotation center of the development sleeve, and the rotation center of the photosensitive drum are aligned in a straight line.

The home positioning operation of the development rotary portion is performed as follows. First, while the development rotary portion is rotated, a home position sensor 808 disposed at and fixed to the body of the image forming apparatus detects a home position flag (position indicator) 807 attached to the driving gear 805 shown in FIG. 6. After the home position flag 807 is detected, the development rotary portion is rotationally driven by the rotary motor 802 by a predetermined angle (in this embodiment, 25°), and then, the development rotary portion is stopped.

The home positioning operation may be performed when the image formation operation is completed, when an image adjustment mode is ended, and/or when the apparatus is started up for the first time in the morning. Additionally or alternatively, the home positioning operation may be performed at a recovery operation when an error such as paper jam occurs and the image formation operation is stopped, and/or at a recovery operation after the developing unit is detached and attached for maintenance or other purpose.

As shown in FIG. 8, when the development rotary portion is at the home position, and the rotation of the rotary developing device is started for next image formation after the toner is accumulated, the condition becomes as follows. Firstly, the yellow developing unit 4*b* facing the region "a" passes through a part of the region "a", and the yellow development sleeve collects the toner accumulated on a portion where the yellow developing unit 4*b* has been passed therethrough. Then, the subsequent magenta developing unit 4*c* passes through the entire region "a", and the magenta development sleeve collects the toner in the entire region "a". With the movement of these two developing units, the accumulated toners which may interfere with the developing sleeves during rotation of the rotary developing device are almost collected. Hence, the transparence developing unit 4*a*, the movement of which is started from the home position, and which reaches the region "a" lastly, hardly collects the toner accumulated in the region "a".

In order to more reliably obtain the advantage, when the rotary developing device is rotated from the home position, it is desired that the developing unit arranged downstream of the transparence developing unit in the rotary developing device rotation direction passes through the entire region "a". However, in many cases, the toner is hardly accumulated in the entire region "a" by such an amount causing the toner to be mixed, during the standby time at the home position. Hence, the advantage can be sufficiently obtained, as long as the color developing unit arranged downstream of the transparence developing unit in the rotary developing device rotation direction passes through the position at the lowermost portion b in the gravity direction of the rotary developing device faster than the transparence developing unit, or the color developing unit is located at a position so that the rotation thereof is started from the lowermost portion b in the gravity direction of the rotary developing device, when the rotary developing device is rotated from the home position.

The position of the developing unit is a position s which is located on the outer circumference of the developing sleeve of the developing unit and is farthest from the rotary developing device rotation center C.

Further, the transparence developing unit is arranged to perform the development operation first. Hence, when image formation is performed first, toner contamination is negligible around the photosensitive drum and toner scattering does not appear during development, thereby reducing the likelihood of occurrence of toner mixture.

Figure 9:
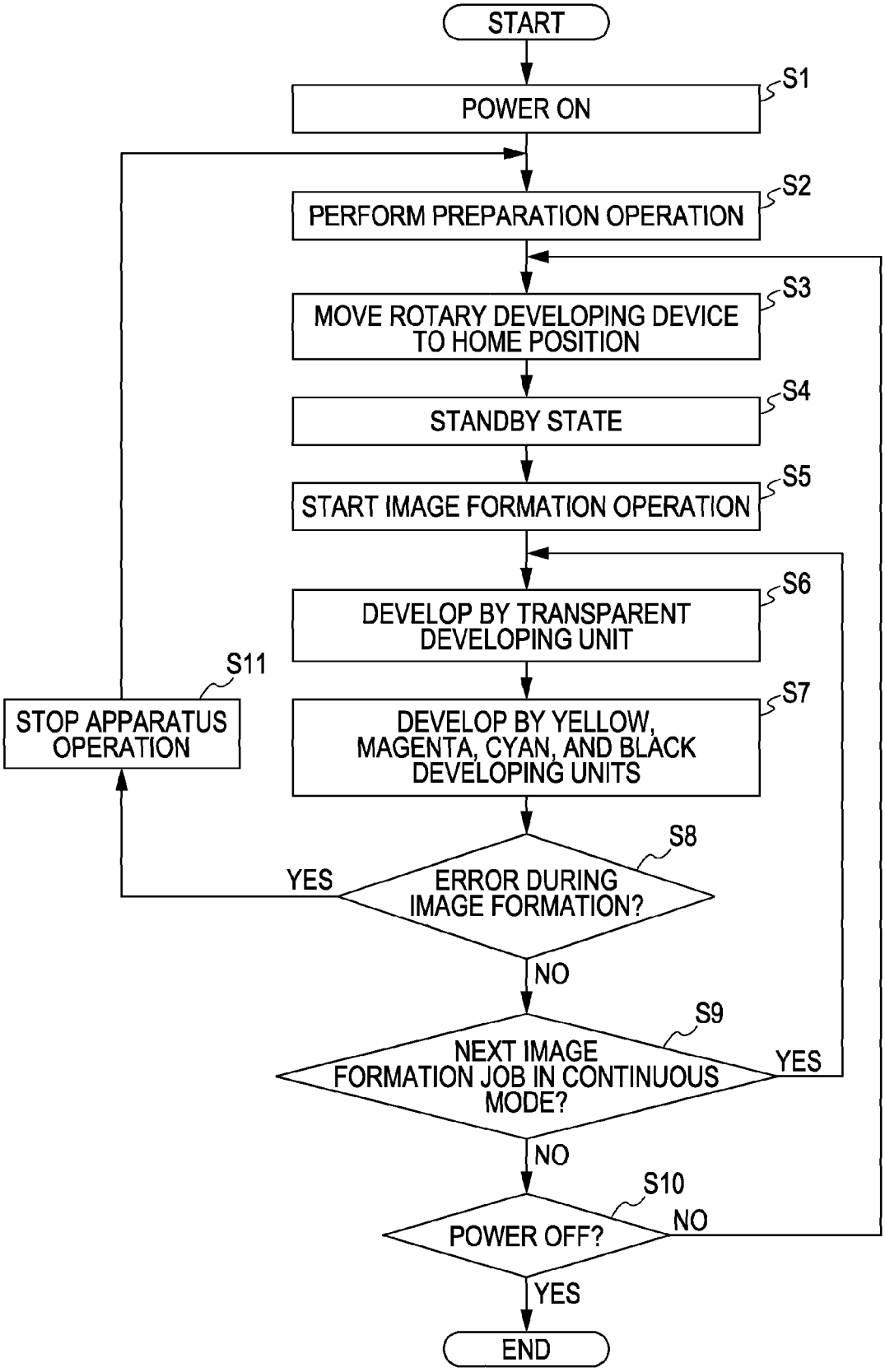
FIG. 9 is a flowchart relating to home positioning of the rotary developing device according to the first embodiment.
Figure 11:
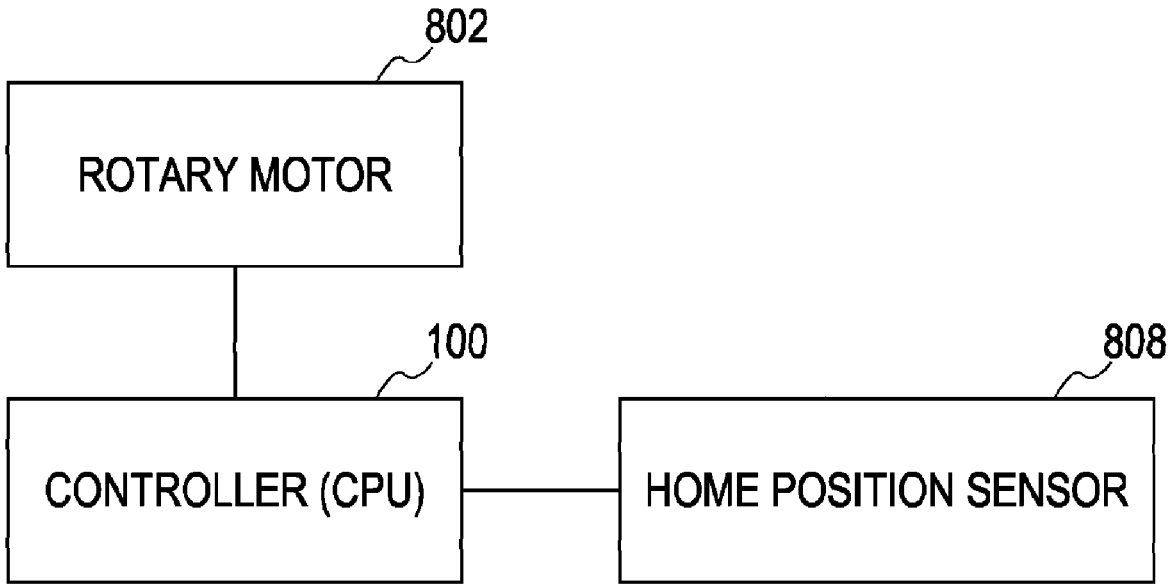
FIG. 11 is a block diagram for control of the flowchart relating to home positioning of the rotary developing device according to the first embodiment.

FIG. 9 shows the above-mentioned operations in the form of flowchart. Also, FIG. 11 is a block diagram showing the control of the flowchart.

First, a main power supply of the image forming apparatus is turned ON (S1). Then, the controller 100 performs a preparation operation of an image formation operation. The preparation operation includes, for example, heating of the fixing device, charging of the photosensitive drum, and cleaning of the photosensitive drum (S2). The controller 100 controls driving of the rotary motor 802 in response to a signal from the home position sensor 808 so as to move the rotary developing device to the home position and stop the rotary developing device at the home position (S3). When the preparation operation and the home positioning operation are completed, the controller 100 is ready to start the image formation operation. Thus, the image forming apparatus is in a standby state (S4). When the image forming apparatus receives an image formation start signal, the image formation operation is started (S5). Firstly, the rotary developing device is moved such that the transparence developing unit is located at the development position, and performs a first development operation (S6). Then, development operations are sequentially performed by the yellow, magenta, cyan, and black developing units in that order (S7). If an error such as paper jam occurs during the image formation operation (S8), the operation of the apparatus is stopped (S11). After the apparatus is stopped, when the error is eliminated by, for example, removing the paper jam, the preparation operation is performed again (S2). During the image formation operation, it is determined whether or not the current image formation job is in a continuous image formation mode and there is an image to be formed next (S9). If there is a continuous image formation job to be formed next, the development rotary portion is not stopped at the home position after the development operation by the black developing unit is completed, and the transparence developing unit is moved to the development position (S6). When the next continuous image formation job is not present, and the main power supply is not turned OFF (S10), the home positioning operation is performed again (S3).

With the above-described operations, even when the toner is accumulated during the standby state, the developing units other than the transparence developing unit collect the toners accumulated first. Hence, the toner mixture to the transparence developing unit can be effectively prevented.

Second Embodiment

In the first embodiment, the yellow developing unit 4*b*, the magenta developing unit 4*c*, the cyan developing unit 4*d*, and the black developing unit 4*e* pass through the lowermost portion b before the transparence developing unit 4*a* reaches the lowermost portion b of the rotary developing device during the movement of the rotary developing device from the home position.

However, as described above, the amount of the toner accumulated at the toner receiver is normally small. Thus, to collect the accumulated toner, at least one of the developing units other than the transparence developing unit may pass through the lowermost portion b.

Figure 10:
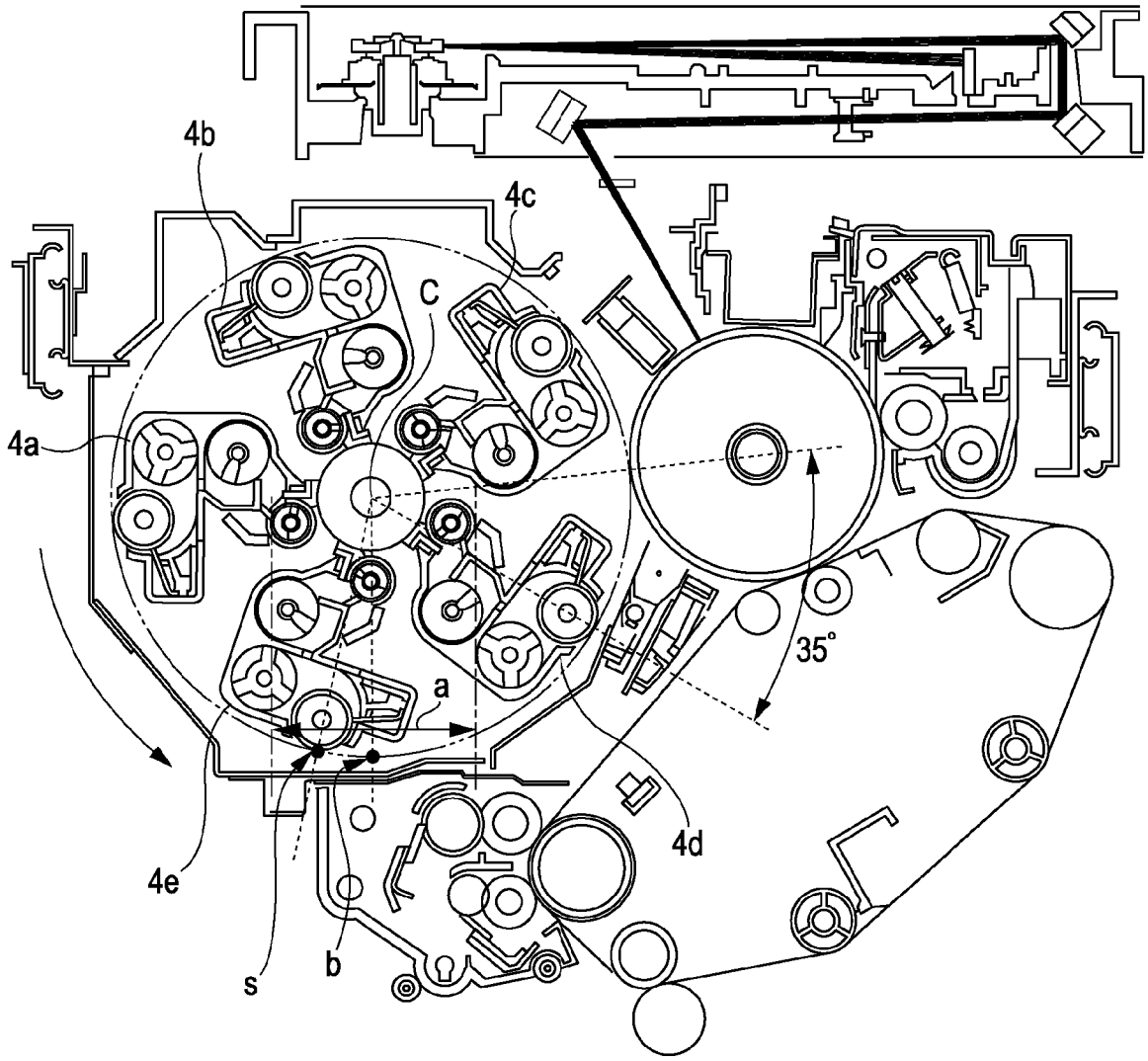
FIG. 10 illustrates a home position of a rotary developing device according to a second embodiment of the present invention.

Hence, the home position may be determined as shown in FIG. 10. In this embodiment, the black developing unit 4*e* is located at a position upstream of the lowermost portion b in the rotary developing device rotation direction. That is, only the black developing unit 4*e* is located upstream of the transparence developing unit 4*a*. In particular, when the rotary member is located at the reference position for the rotation start, at least one of the plurality of color developing units is located in a region arranged downstream of the transparence developing unit and arranged upstream of the lowermost portion of the rotary member in the gravity direction with reference to the rotation direction of the rotary member.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2007-314795 filed Dec. 5, 2007, which is hereby incorporated by reference herein in its entirety.

What is claimed is:

1. An image forming apparatus comprising:

an image bearing member on which an electrostatic image is formed;

a color developing unit having a color developing agent bearing member configured to bear a color developing agent containing a color toner, the color developing unit configured to develop the electrostatic image formed on the image bearing member at a development position;

a transparence developing unit having a transparent developing agent bearing member configured to bear a transparent developing agent containing a transparent toner, the transparence developing unit configured to develop the electrostatic image formed on the image bearing member at the development position;

a rotary member configured to hold the color developing unit and the transparence developing unit and to rotationally move the held color developing unit and the held transparence developing unit toward the development position;

a driving device configured to rotationally drive the rotary member;

a toner accumulation portion arranged below the rotary member in a gravity direction, falling toner accumulating therein; and a controller configured to control the driving device such that the rotary member is in a standby state at a reference position before image formation;

wherein, when the rotary member is located at the reference position, the color developing agent bearing member is located in a region extending from a position of the transparent developing agent bearing member toward a downstream side of a rotation direction of the rotary member to a lowermost point in the gravity direction of the rotary member.

2. The image forming apparatus according to claim 1, wherein the rotary member is capable of holding a plurality of different color developing units including a black developing unit, and when the rotary member is located at the reference position, the black developing agent bearing member is firstly located upstream, with respect to the rotation direction of the rotary member, of the lowermost point in the gravity direction of the rotary member.

3. The image forming apparatus according to claim 1, wherein the rotary member holds a plurality of different color developing units, and when the rotary member is located at the reference position, the transparent developing agent bearing member is firstly located downstream, with respect to the rotation direction of the rotary member, of the lowermost point in the gravity direction of the rotary member.

4. The image forming apparatus according to claim 1, wherein, when the rotary member is located at the reference position, the transparent developing agent bearing member is held within a region arranged downstream of the lowermost point in the gravity direction of the rotary member and arranged upstream of the development position, with upstream and downstream determined with respect to the rotation direction of the rotary member.

5. The image forming apparatus according to claim 1, wherein the color developing unit includes a developing agent supply port through which a developing agent is supplied, and wherein when the rotary member is located at the reference position, a first region, which extends from a position of the transparent developing agent bearing member to a position of the color developing agent bearing member adjacently arranged downstream of the transparent developing agent bearing member with respect to the rotation direction of the rotary member, is arranged so as not to be superposed on a second region in which a circular locus of rotational movement of the supply port is projected downward in the gravity direction.

6. An image forming apparatus comprising:

an image bearing member on which an electrostatic image is formed;

a color developing unit having a color developing agent bearing member configured to bear a color developing agent containing a color toner, the color developing unit being configured to develop the electrostatic image formed on the image bearing member at a development position;

a transparent developing unit having a transparent developing agent bearing member configured to bear a transparent developing agent containing a transparent toner, the transparent developing unit being configured to develop the electrostatic image formed on the image bearing member at the development position;

a rotary member configured to hold the color developing unit and the transparent developing unit and to rotationally move the held color developing unit and the held transparent developing unit toward the development position;

a driving device configured to rotationally drive the rotary member;

a toner receiver arranged below the rotary member in a gravity direction and configured to receive a falling toner; and a controller configured to control the driving device such that the rotary member is in a standby state at a reference position before image formation, wherein, when the rotary member is at the reference position, a plurality of color developing unit including at least a color developing unit to contain a black toner is located in a region extending from a position of the transparent developing unit toward a downstream side of a rotation direction of the rotary member to a lowermost point in the gravity direction of the rotary member.

* * * * *